US006033194A

United States Patent [19]

Iizuka

[11] Patent Number: 6,033,194

[45] Date of Patent: Mar. 7, 2000

[54] SCROLL-TYPE FLUID DISPLACEMENT APPARATUS WITH ANTI-WEAR PLATE MECHANISM

[75] Inventor: Jiro Iizuka, Takasaki, Japan

[73] Assignee: Sanden Corporation, Gunma, Japan

[21] Appl. No.: 08/878,139

[22] Filed: Jun. 19, 1997

[30] Foreign Application Priority Data

Jun. 24, 1996 [JP] Japan ..... 08-163286

[51] Int. Cl.[7] ..... F01C 1/04; F01C 19/08

[52] U.S. Cl. ..... 418/55.2; 418/55.4; 418/142; 418/178

[58] Field of Search ..... 418/55.2, 55.4, 418/142, 178

[56] References Cited

U.S. PATENT DOCUMENTS

| | | | |
|---|---|---|---|
| 3,986,799 | 10/1976 | McCullugh | 418/56 |
| 3,994,636 | 11/1976 | McCullough et al. | 418/55.4 |
| 4,047,855 | 9/1977 | Goloff et al. | 418/53 |
| 4,487,560 | 12/1984 | Uchikawa et al. | 418/178 |
| 4,498,852 | 2/1985 | Hiraga | 418/178 |
| 4,540,355 | 9/1985 | Sakaki et al. | 418/178 |
| 4,645,436 | 2/1987 | Sakamoto | 418/178 |
| 4,890,987 | 1/1990 | Sato et al. | 418/178 |
| 5,037,279 | 8/1991 | Suefuji et al. | 418/55.2 |
| 5,059,102 | 10/1991 | Tokumitsu et al. | 418/55.2 |
| 5,122,041 | 6/1992 | Yokota et al. | 418/55.4 |
| 5,249,943 | 10/1993 | Kuroki et al. | 418/55.2 |

FOREIGN PATENT DOCUMENTS

| | | | |
|---|---|---|---|
| 0012615 | 6/1980 | European Pat. Off. . | |
| 0060496 | 9/1982 | European Pat. Off. . | |
| 0061065 | 9/1982 | European Pat. Off. . | |
| 0106288-A1 | 4/1984 | European Pat. Off. . | |
| 0122722 | 10/1984 | European Pat. Off. . | |
| 0404512 | 12/1990 | European Pat. Off. . | |
| 5823516 | 9/1978 | Japan . | |
| 55-35155 | 3/1980 | Japan . | |
| 56-147386 | 11/1981 | Japan . | |
| 57-148088 | 9/1982 | Japan . | |
| 58-192901 | 11/1983 | Japan . | |
| 58-200092 | 11/1983 | Japan . | |
| 61-171801 | 1/1985 | Japan . | |
| 63-65187 | 3/1988 | Japan | 418/55.2 |
| 63-100288 | 5/1988 | Japan . | |
| 63-296326 | 11/1988 | Japan . | |
| 63-41589 | 11/1988 | Japan . | |
| 1147181 | 6/1989 | Japan . | |
| 3-61687 | 3/1991 | Japan | 418/55.2 |
| 3260389 | 11/1991 | Japan . | |
| 4350378 | 4/1992 | Japan . | |
| 4279785 | 10/1992 | Japan . | |
| 6101665 | 4/1994 | Japan . | |
| 7139480 | 5/1995 | Japan . | |
| 2161218 | 1/1986 | United Kingdom . | |
| 2167133 | 5/1986 | United Kingdom . | |

*Primary Examiner*—John J. Vrablik
*Attorney, Agent, or Firm*—Baker & Botts, LLP

[57] ABSTRACT

A scroll-type fluid displacement apparatus includes a pair of scroll members, each having a circular end plate and a spiral wrap element extending from an axial end surface of the circular end plate. An anti-wear plate member is disposed in the inner surface of the end plate of at least one of the scroll members and extends from a first place adjacent the radial center of the end plate to a second place positioned radially and spirally inward of the outer terminal end of the spiral wrap element of the scroll member. An axial gap is formed between the radial center of the inner surface of the end plate of the scroll member and the radial inner end of the spiral wrap element of the opposite scroll member. The radial inner end of the spiral wrap element of one scroll member is thereby prevented from contact with the radial center of the inner surface of the end plate of the other scroll member.

11 Claims, 4 Drawing Sheets

SCROLL-TYPE FLUID DISPLACEMENT APPARATUS WITH ANTI-WEAR PLATE MECHANISM

BACKGROUND OF THE INVENTION

1. Field of the Invention

The present invention relates to a scroll-type fluid displacement apparatus, and more particularly, to an anti-wear plate mechanism for the spiral elements of the scroll members used in a scroll-type fluid compressor.

2. Description of Related Art

Scroll-type fluid displacement apparatuses are known in the art. For example, U.S. Pat. No. 5,249,943, which disclosure is incorporated herein by reference, discloses a basic construction of a scroll-type fluid displacement apparatus including two scroll members, each having an end plate and a spiroidal or involute spiral wrap element extending from the end plates. The scroll members are maintained angularly and radially offset so that both spiral elements interfit to form a plurality of line contacts between their spiral curved surfaces to thereby seal off and define at least one pair of fluid pockets. The relative orbital motion of the two scroll members shifts the line contact along the spiral curved surfaces and, as a result, changes the volume in the fluid pockets. The volume of the fluid pockets increases or decreases depending on the direction of orbital motion. Thus, the scroll-type apparatus is able to compress, expand or pump fluids.

In comparison with conventional piston type compressors, scroll-type compressors have certain advantages. For instance, they use fewer parts and allow continuous compression of fluid. However, one of the problems with scroll-type compressors is difficulty in sealing the fluid pockets. Axial and radial sealing of the fluid pockets must be maintained in a scroll-type compressor in order to achieve efficient operation. The fluid pockets are defined by line contacts between the interfitting spiral elements and axial contact between the axial end surface of one spiral element and the inner end surface of the facing end plate.

Various techniques have been used to address the sealing problem, in particular, that relating to axial sealing. In U.S. Pat. No. 3,994,636, which disclosure is incorporated herein by reference, a seal element is mounted in a groove formed in the axial end surface of each spiral element. An axial force urging means in each groove, such as a spring, urges the seal element towards the facing end surface of the end plate, thereby effecting an axial sealing.

Because the seal element disclosed in the above patent is urged towards the facing end surface of the end plate by a spring or other axial force urging mechanism, over period of time, wear occurs between the end surface of the seal element and the end plate of the scroll member, especially when a lightweight alloy, such as an aluminum alloy, is used as the material for the scroll member.

One solution to these problems with respect to wear is disclosed in U.S. Pat. No. 4,047,855, which disclosure is incorporated herein by reference. This patent discloses an involute anti-wear plate disposed between the axial end surface of the spiral element and the inner end surface of the opposite end plate. The involute anti-wear plate covers the area of the surface of the end plate where the other spiral element makes axial contact during orbital motion. Excessive wear or abrasion of the end plate is thereby prevented.

It should be noted that, in scroll-type fluid compressors, the interfitting spiral elements, normally constructed of lightweight alloys, such as an aluminum alloy, are subject to several temperature zones which are caused by the increasing pressure and decreasing volume as fluid moves to the center of the compressor. The greatest temperature exists in the center of the compressor, as this pocket has the smallest volume and largest pressure. This causes greater thermal expansion at the center of the spiral elements than at any other portion. Because the thermal expansion coefficient of aluminum alloy is generally greater than that of steel, aluminum will be affected more by temperature changes than steel. As the center of the spiral element expands thermally, the center of the involute anti-wear plate is subjected to higher stress than the outer radial portions. As a result, the center of the spiral element is more easily subjected to damage and failure.

Further, Japanese Utility Model Patent No. JP SHO63-41589, which disclosure is incorporated herein by reference, discloses a scroll-type compressor in which an anti-wear plate is also disposed between the axial end surface of the spiral elements and the inner end surface of the opposite end plate. The axial end surface of the spiral element includes a recessed portion formed at the center thereof. The recessed portion is such that the anti-wear plate is more deeply placed according to the thermal expansion of the spiral elements. Thereby, the construction could absorb the thermal expansion by the partial depression of the anti-wear plate.

However, this construction allows the center of the involute anti-wear plate to be repeatedly subjected to high stress due to bending. Thus, the center portion of the anti-wear plate is easily subject to abrasion, damage, and failure.

SUMMARY OF THE INVENTION

It is an object of the present invention to provide a scroll-type fluid or refrigerant displacement apparatus with an anti-wear plate mechanism which prevents excess abrasion of the anti-wear plate and damage to the spiral wrap element of each of the scroll members.

It is another object of the present invention to provide a fluid displacement apparatus which has a long, useful life.

According to the present invention, a scroll-type fluid displacement apparatus includes a housing, having a fluid inlet port and a fluid outlet port, and a first scroll member and a second scroll member. Each scroll member has an end plate and a spiral wrap element extending from one side of each of the end plates. The spiral wrap elements interfit at an angular and a radial offset to make a plurality of line contacts between their spiral curved surfaces, which define at least one pair of sealed off fluid pockets. One of the scroll members is an orbiting scroll member and the other scroll member is a fixed scroll member. A driving mechanism, including a drive shaft rotatably supported by the housing, is operatingly connected to the orbiting scroll member and effects an orbital motion of the orbiting scroll member with respect to the other scroll member by rotation of the drive shaft, thereby changing the volume of the fluid pockets.

A first anti-wear plate member is disposed on an inner surface of the end plate of the first scroll member and extends from a first place adjacent the radial center of the inner surface of the end plate of the first scroll member to a second place positioned radially and spirally inward of the outer terminal end of the spiral wrap element of the first scroll member. An axial gap is formed between the radial center of the inner surface of the end plate of the first scroll member and the radial inner end of the spiral wrap element of the second scroll member, so that the radial inner end of the spiral wrap element of the second scroll member does not make contact with the radial center of the inner surface of the end plate of the first scroll member.

Further objects, features, and advantages of this invention will be understood from the following detailed description of preferred embodiments of this invention with reference to the attached drawings.

DETAILED DESCRIPTION OF PREFERRED EMBODIMENTS

Figure 1:
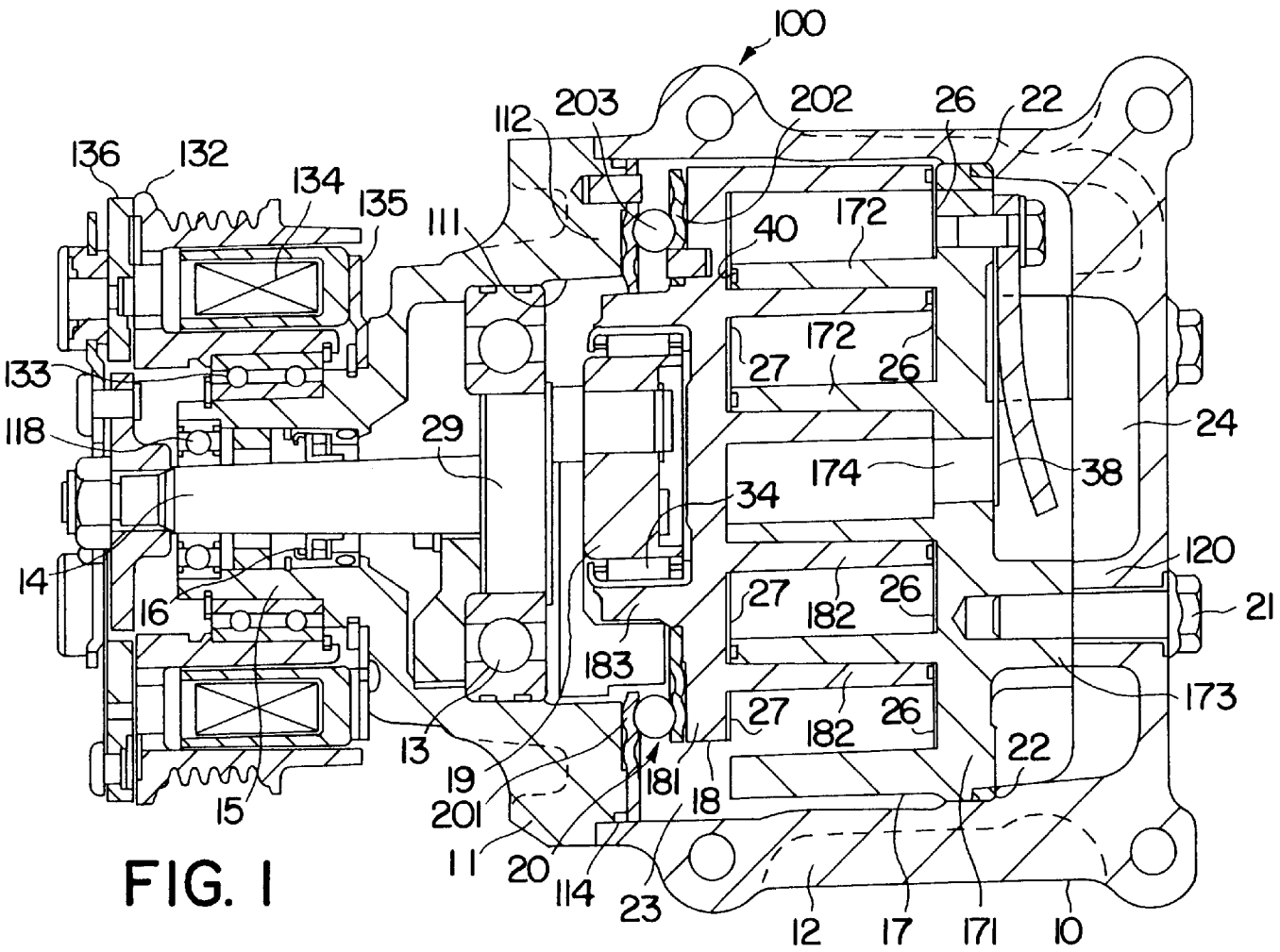
FIG. 1 is a cross-sectional view of a scroll-type fluid compressor in accordance with an embodiment of the present invention.

Referring to FIG. 1, a fluid displacement apparatus in accordance with the present invention is shown in the form of scroll-type fluid compressor unit 100.

Compressor unit 100 includes compressor housing 10 having front end plate 11 mounted on cup-shaped casing 12.

An opening 111 is formed in the center of front end plate 11 for penetration of a drive shaft 14. Annular projection 112 is formed in the rear end surface of front end plate 11. Annular projection 112 faces cup-shaped casing 12 and is concentric with opening 111. The outer peripheral surface of annular projection 112 extends into the inner wall of the opening of cup-shaped casing 12 so that the opening of cup-shaped casing 12 is covered by front end plate 11. An O-ring 114 is placed between the outer peripheral surface of annular projection 112 and the inner wall of the opening of cup-shaped casing 12 to seal the mating surface of front end plate 11 and cup-shaped casing 12.

An annular sleeve 15 projects from the front end surface of front end plate 11 to surround drive shaft 14. Annular sleeve 15 defines a shaft seal cavity. In the embodiment shown in FIG. 1, annular sleeve 15 is formed integrally with front end plate 11. Alternatively, annular sleeve 15 may be formed separately from front end plate 11.

Drive shaft 14 is rotatably supported by annular sleeve 15 through bearing 118 located within the front end of annular sleeve 15. Drive shaft 14 has disk 29 at its inner end. Disk 29 is rotatably supported by front end plate 11 through bearing 13 located within opening 111 of front end plate 11. A shaft seal assembly 16 is coupled to drive shaft 14 within the shaft seal cavity of annular sleeve 15.

A pulley 132 is rotatably supported by bearing 133, which is carried on the outer surface of annular sleeve 15. An electromagnetic coil 134 is fixed above the outer surface of annular sleeve 15 by support plate 135, and is disposed within an annular cavity of pulley 132. An armature plate 136 is elastically supported on the outer end of drive shaft 14. Pulley 132, electromagnetic coil 134, and armature plate 136 form a magnetic clutch. In operation, drive shaft 14 is driven by an external drive power source, for example, the engine of an automobile, through a rotation transmitting device, such as a magnetic clutch.

A number of elements are located within the inner chamber of cup-shaped casing 12 including a fixed scroll 17, an orbiting scroll 18, a driving mechanism for orbiting scroll 18 and a rotation preventing/thrust bearing device 20 for orbiting scroll 18. The inner chamber of cup-shaped casing 12 is formed between the inner wall of cup-shaped casing 12 and the rear end surface of front end plate 11.

Fixed scroll 17 includes circular end plate 171, spiral wrap element 172 affixed to or extending from one end surface of circular end plate 171 and internal threaded bosses 173 axially projecting from the other end surface of circular end plate 171. An axial end surface of each boss 173 is seated on the inner surface of bottom plate portion 120 of cup-shaped casing 12 and fixed by screws 21 screwed into bosses 173. Thus, fixed scroll 17 is fixed within the inner chamber of cup-shaped casing 12. Circular end plate 171 of fixed scroll 17 partitions the inner chamber of cup-shaped casing 12 into a front chamber 23 and a rear chamber 24. A seal ring 22 is disposed within a circumferential groove of circular end plate 171 to form a seal between the inner wall of cup-shaped casing 12 and the outer surface of circular end plate 171. Spiral wrap element 172 of fixed scroll 17 is located within front chamber 23.

Cup-shaped casing 12 is provided with a fluid inlet port and fluid outlet port (not shown), which are connected to rear and front chambers 23 and 24, respectively. A discharge port 174 is formed through circular end plate 171 at a position near the center of spiral wrap element 172. A reed valve 38 closes discharge port 174.

Orbiting scroll 18, which is located in front chamber 23, includes a circular end plate 181 and a spiral wrap element 182 affixed to or extending from one side surface of circular end plate 181. Spiral wrap elements 172 and 182 interfit at an angular offset of 180 degrees and a predetermined radial offset. Spiral wrap elements 172 and 182 define at least one pair of sealed off fluid pockets between their interfitting surfaces. Orbiting scroll 18 is rotatably supported by bushing 19 through bearing 34 placed between the outer peripheral surface of bushing 19 and the inner surface of annular boss 183 axially projecting from the end surface of circular end plate 181 of orbiting scroll 18 which faces end plate 11. Bushing 19 is connected to an inner end of disk 29 at a point radially offset or eccentric with respect to drive shaft 14.

Rotation preventing/thrust bearing device 20 is disposed between the inner end surface of front end plate 11 and the end surface of circular end plate 181 facing front end plate 11. Rotation preventing/thrust bearing device 20 includes fixed ring 201 attached to the inner end surface of front end plate 11, orbiting ring 202 attached to the end surface of circular end plate 181 facing front end plate 11, and a plurality of bearing elements, such as balls 203, placed between the pockets formed by rings 201 and 202. The axial thrust load from orbiting scroll 18 is also supported on front end plate 11 through balls 203.

Referring now to FIGS. 1–7, spiral wrap elements 172 and 182 each include a groove 41 on the axial end surfaces thereof. Seal element 40 is disposed in groove 41 to provide a seal between the end surface of each circular end plate 171 and 181 and the axial end surface of each seal element 40.

Figure 2:
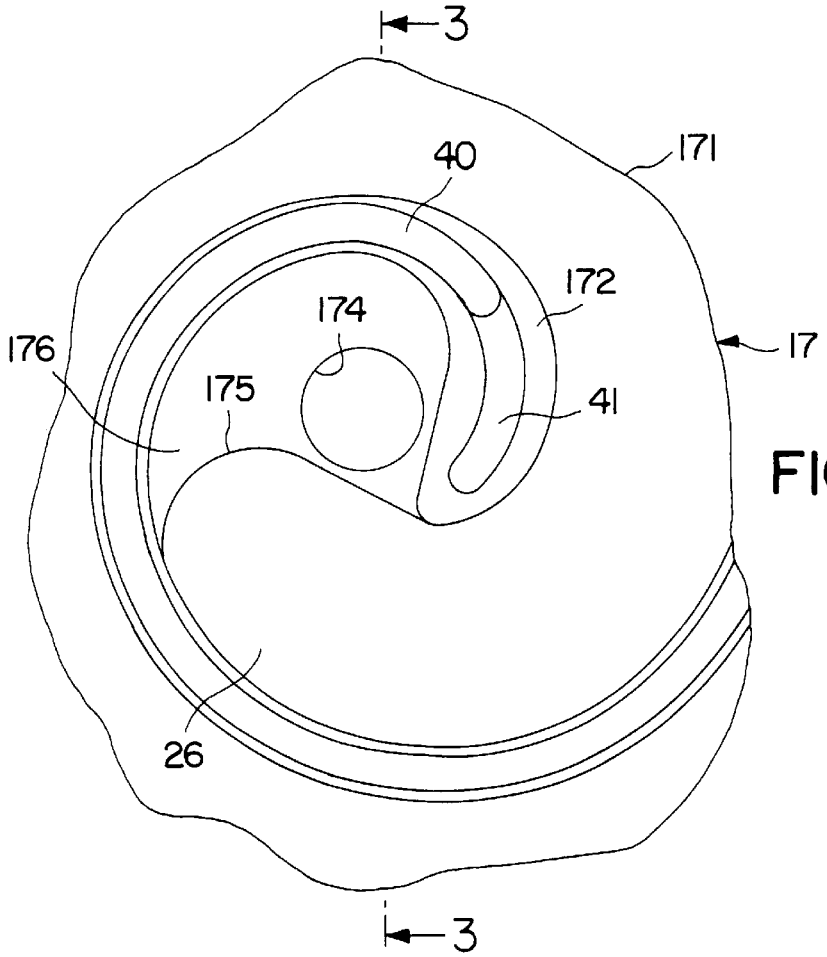
FIG. 2 is an enlarged front view of a fixed scroll member of the scroll-type fluid compressor in accordance with the embodiment of the present invention.
Figure 3:
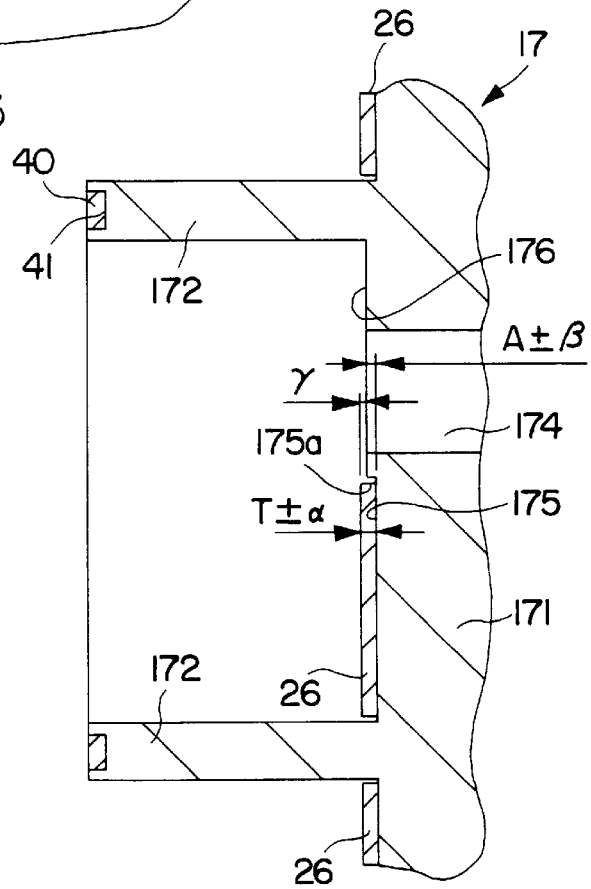
FIG. 3 is an enlarged partial cross sectional view of the fixed scroll member taken along line 3—3 of FIG. 2.
Figure 4:
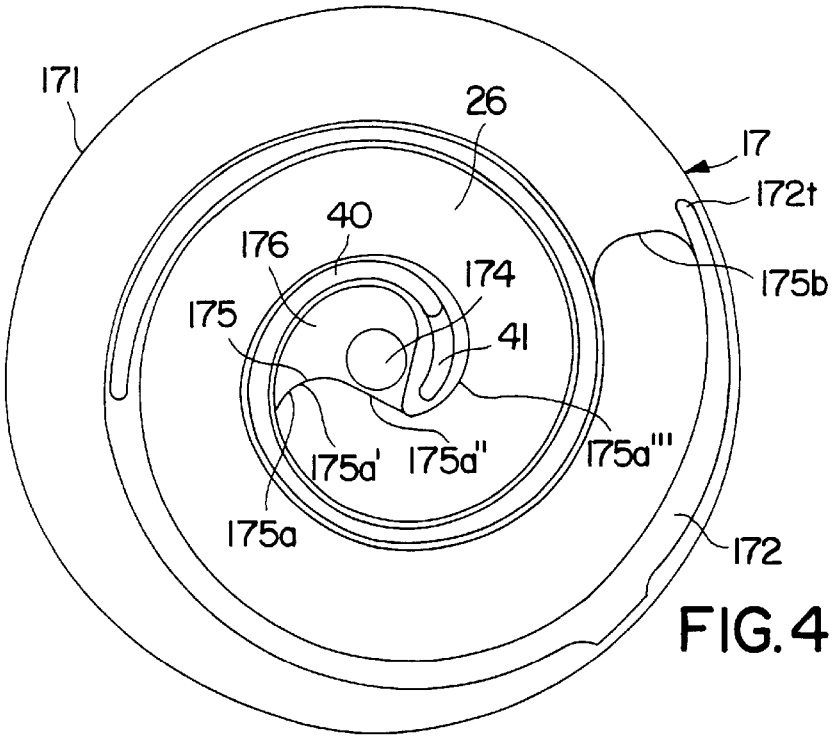
FIG. 4 is a front view of the fixed scroll member of the scroll-type fluid compressor in accordance with the embodiment of the present invention.

Referring now to FIGS. 2–4, fixed scroll 17 includes a recessed portion 175 formed on inner surface 176 of circular end plate 171. Recessed portion 175 has an involute shape and is formed in the spiral area between the wall of spiral wrap element 172. Recessed portion 175 extends from a first place positioned near discharge port 174 to a second place positioned radially and spirally inward of the outer terminal end 172*t* of spiral wrap element 172.

Referring now to FIGS. 1–3, involute anti-wear plate 26, which is formed of hard metal, such as hardened steel, is closely inserted into recessed portion 175 of inner surface 176 of circular end plate 171 in order to prevent wear between inner surface 176 of circular end plate 171 and the axial end of spiral wrap element 182, and to minimize abrasion and reduce wear of the scroll members.

Further, the radial inner end portion of involute anti-wear plate 26, which is inserted into recessed portion 175, terminates adjacent to discharge port 174 of fixed scroll 17 such that involute anti-wear plate 26 does not cover or otherwise block discharge port 174.

FIG. 3 shows the relationship between a depth A of recessed portion 175 and a thickness T of involute anti-wear plate 26. The relationship is represented by the following equation:

$$(T-\alpha)-(A+\beta)=\gamma \quad (1)$$

where $\gamma$ is a minimum gap created between the axial end of involute anti-wear plate 26 and inner surface 176 of circular end plate 171, where thickness T of involute anti-wear plate 26 has a tolerance $\alpha$, and where the depth A of recessed portion 175 has a tolerance $\beta$.

Preferably, the value of $\gamma$ is such that seal element 40 of spiral wrap element 182 does not contact inner surface 176 of circular end plate 171 at the center portion of circular end plate 171. The value of $\gamma$ is preferably about 20–100 $\mu$m.

Referring now to FIGS. 3 and 4, recessed portion 175 includes a pair of edge walls 175*a* and 175*b* formed at the two radial sides thereof. Edge wall 175*a* is defined by the arc of a semicircle 175*a*' or a line having a substantially semicircular shape, a line segment 175*a*" and a spiral line 175*a*'". The arc has a radius of curvature which is greater than that which could be worked by an end mill as shown in FIG. 4.

Figure 5:
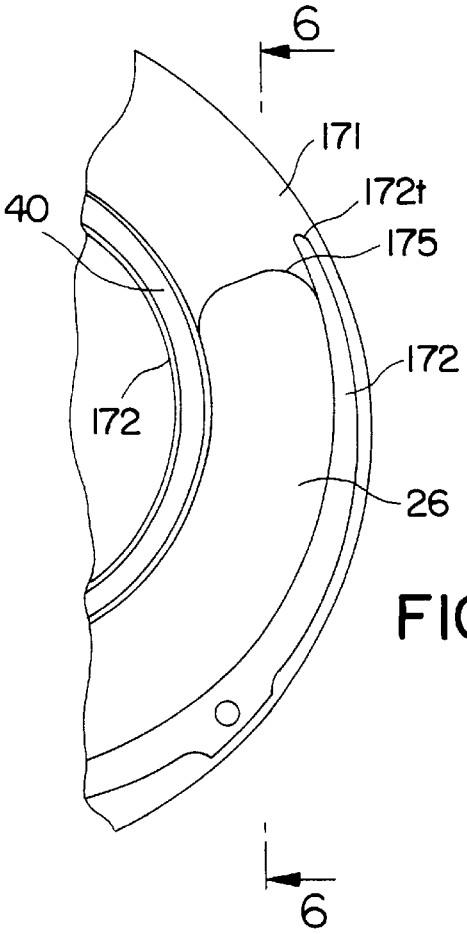
FIG. 5 is an enlarged partial front view of the fixed scroll member of the scroll-type fluid compressor in accordance with the embodiment of the present invention.

Furthermore, as shown in FIG. 5, the radial outermost portion of involute anti-wear plate 26, which is inserted into recessed portion 175, terminates adjacent the outer terminal end 172*t* of spiral wrap element 172 of fixed scroll 17 such that involute anti-wear plate 26 does not protrude spirally or radially outward from the outer terminal end 172*t* of spiral wrap element 172. It should be noted that if involute anti-wear plate 26 protruded spirally and radially outward from the outer terminal end 172*t* of spiral wrap element 172, the axial end of spiral wrap element 182 would not be in continuous contact with the portion of involute anti-wear plate 26 protruding from the outer terminal end 172*t* of spiral wrap element 172 during operation of the displacement apparatus, thereby allowing the portion of involute anti-wear plate 26 to vibrate.

Figure 6:
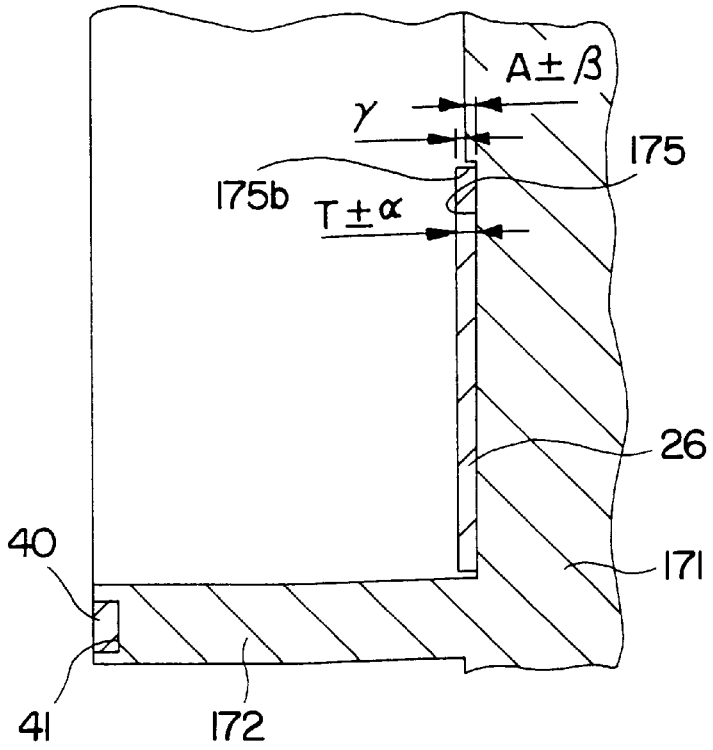
FIG. 6 is an enlarged partial cross-sectional view of the fixed scroll member taken along line 6—6 of FIG. 5.

FIG. 6 shows the relationship between a depth A of recessed portion 175 and a thickness T of involute anti-wear plate 26 near the outer terminal end 172*t* of spiral wrap element 172. The relationship is also represented by equation (1) in FIG. 3.

Figure 7:
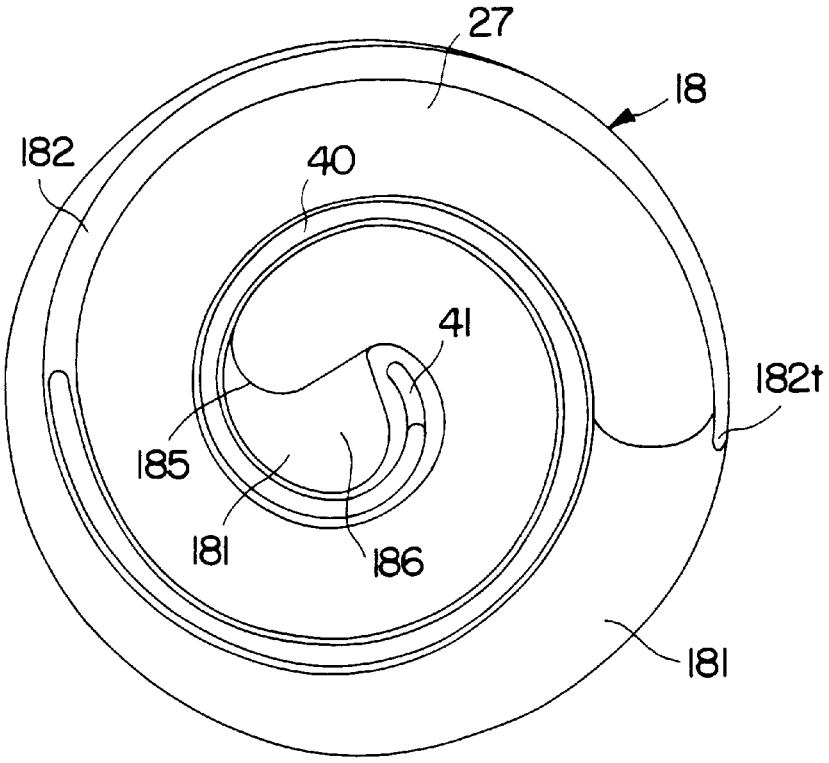
FIG. 7 is a front view of an orbiting scroll member of the scroll-type fluid compressor in accordance with the embodiment of the present invention.

FIG. 7 shows the orbiting scroll assembly having an anti-wear plate mechanism similar to the fixed scroll assembly. Orbiting scroll 18 includes a recessed portion 185 formed on an inner surface 186 of circular end plate 181 thereof. Recessed portion 185 has an involute shape and is formed in the spiral area between the wall of spiral wrap element 182. Recessed portion 185 extends from a first position near the center of inner surface 186 of circular end plate 181 to a second position inside the outer terminal end 182*t* of spiral wrap element 182. Involute anti-wear plate 27, which is formed of a hard metal, such as hardened steel, is inserted into recessed portion 185 of the inner surface 186 of circular end plate 181 in order to reduce or eliminate wear between inner surface 186 of circular end plate 181 and the axial end of spiral wrap element 172, and to reduce abrasion and to reduce or eliminate wear of the scroll members.

Further, involute anti-wear plate 27 does not cover the radial center of inner surface 186 of circular end plate 181 and does not protrude spirally or radially outward from the outer terminal end 182*t* of spiral wrap element 182.

Therefore, involute anti-wear plates 26 and 27 can have the same shape as each other, although involute anti-wear plates 26 and 27 are positioned, so that they form mirror images of each other, as shown in FIGS. 4 and 7.

Referring again to FIG. 1, in the above arrangement of a scroll-type fluid compressor, fluid from the external fluid circuit is introduced into the fluid pockets in the compressor unit through an inlet port (not shown). The fluid pockets comprise open spaces formed between spiral wrap elements 172 and 182. As orbiting scroll 18 orbits, the fluid in the fluid pockets moves to the center of the spiral wrap elements and is compressed. The compressed fluid from the fluid pockets is discharged into rear chamber 24 from the fluid pockets through discharge port 174. The compressed fluid is then discharged to the external fluid circuit through a fluid outlet port (not shown).

According to the present invention, a predetermined gap $\gamma$ is created between the center portions of the inner surfaces of the end plates of the fixed and orbiting scroll members and the axial ends of the spiral wrap elements of the fixed and orbiting scroll members. Thus, the axial ends of the spiral wrap elements are not subjected to stress caused by the involute anti-wear plates, even when the centers of the spiral wrap elements expand thermally. As a result, the centers of the spiral wrap elements are not subjected to damage and failure.

In addition, the arrangement can be simply manufactured at low cost because a single involute anti-wear plate can be used in either the fixed or orbiting scroll member.

Although the present invention has been described in connection with preferred embodiments, the invention is not limited thereto. The embodiments and features disclosed herein are provided by way of example only. It will be understood by those of ordinary skill in the art that variations and modifications may be made within the scope of this invention as defined by the following claims.

I claim:

1. A scroll-type fluid displacement apparatus comprising:

a housing having a fluid inlet port and a fluid outlet port;

a first scroll member and a second scroll member, each having an end plate and a spiral wrap element extending from one side of each of said end plates, said spiral wrap elements interfitting at an angular and a radial offset to make a plurality of line contacts defining at least one pair of sealed off fluid pockets, and wherein one of said first and second scroll members is an orbiting scroll member and the other of said first and second scroll members is a fixed scroll member;

a driving mechanism including a drive shaft rotatably supported by said housing to effect an orbital motion of said orbiting scroll member by rotation of said drive shaft to thereby change the volume of said fluid pockets;

a first anti-wear plate member closely inserted in a recess on an inner surface of said end plate of said first scroll member and extending from a first place adjacent a radial center of said inner surface of said end plate of said first scroll member to a second place positioned radially and spirally inward of an outer terminal end of said spiral wrap element of said first scroll member; and an axial gap formed between said radial center of said inner surface of said end plate of said first scroll member and a radial inner end of said spiral wrap element of said second scroll member so that said radial inner end of said spiral wrap element of said second scroll member does not contact said radial center of said inner surface of said end plate of said first scroll member.

2. The scroll-type fluid displacement apparatus of claim 1, wherein said axial gap is greater than about 20 $\mu$m and less than or equal to about 100 $\mu$m.

3. The scroll-type fluid displacement apparatus of claim 1, further comprising a second anti-wear plate member having substantially the same shape as said first anti-wear plate member, said second anti-wear plate member being disposed on an inner surface of said end plate of said second scroll member.

4. The scroll-type fluid displacement apparatus of claim 1, wherein each of said spiral wrap elements of said first and said second scroll members has an axial end surface thereon and each of said axial end surfaces has a seal element disposed therein.

5. The scroll-type fluid displacement apparatus of claim 1, further comprising a discharge port formed at a radial center of said end plate of said fixed scroll member.

6. A scroll-type fluid displacement apparatus comprising:

a housing having a fluid inlet port and a fluid outlet port;

a first scroll member and a second scroll member, each having an end plate and a spiral wrap element extending from one side of each of said end plates, said spiral wrap elements interfitting at an angular and a radial offset to make a plurality of line contacts defining at least one pair of sealed off fluid pockets, and wherein one of said first and second scroll members is an orbiting scroll member and the other of said first and second scroll members is a fixed scroll member;

a driving mechanism including a drive shaft rotatably supported by said housing to effect an orbital motion of said orbiting scroll member by rotation of said drive shaft to thereby change the volume of said fluid pockets;

a recessed portion defined on an inner surface of said end plate of said first scroll member and extending from a first place adjacent a radial center of said inner surface of said end plate of said first scroll member; and a first anti-wear plate member closely inserted in said recessed portion of said inner surface of said end plate of said first scroll member, so as to always be in engagement with a bottom of said recessed portion, wherein a thickness of said first anti-wear plate member is greater than a depth of said recessed portion, so that an axial gap is formed between said radial center of said inner surface of said end plate of said first scroll member and a radial inner end of said spiral wrap element of said second scroll member.

7. The scroll-type fluid displacement apparatus of claim 6, wherein said recessed portion extends to a second place positioned radially and spirally inward of an outer terminal end of said spiral wrap element of said first scroll member.

8. The scroll-type fluid displacement apparatus of claim 6, wherein a difference between said thickness of said first anti-wear plate member and said depth of said recessed portion is greater than about 20 $\mu$m and less than or equal to about 100 $\mu$m.

9. The scroll-type fluid displacement apparatus of claim 6, wherein a second anti-wear plate member having substantially the same shape as said first anti-wear plate member is disposed in a recessed portion on an inner surface of said second scroll member.

10. The scroll-type fluid displacement apparatus of claim 6, wherein said spiral wrap element of said first scroll member has an axial end surface thereon and said axial end surface has a seal element disposed therein.

11. The scroll-type fluid displacement apparatus of claim 6, further comprising a discharge port formed at said radial center of said end plate of said fixed scroll member.

* * * * *